US010495114B2

(12) United States Patent
Kondou et al.

(10) Patent No.: US 10,495,114 B2
(45) Date of Patent: Dec. 3, 2019

(54) BLOWER

(71) Applicant: DENSO CORPORATION, Kariya, Aichi-pref. (JP)

(72) Inventors: Toshikatsu Kondou, Kariya (JP); Youhei Kamiya, Kariya (JP); Masaru Kamiya, Kariya (JP); Takeshi Miyamoto, Kariya (JP); Masashi Matsukawa, Kariya (JP); Isao Kondoh, Kariya (JP); Takashi Ito, Kariya (JP); Kazuhiro Takeuchi, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 417 days.

(21) Appl. No.: 15/112,710

(22) PCT Filed: Feb. 20, 2015

(86) PCT No.: PCT/JP2015/000806

§ 371 (c)(1),
(2) Date: Jul. 20, 2016

(87) PCT Pub. No.: WO2015/125486

PCT Pub. Date: Aug. 27, 2015

(65) Prior Publication Data

US 2016/0333893 A1 Nov. 17, 2016

(30) Foreign Application Priority Data

Feb. 21, 2014 (JP) ..... 2014-031517

(51) Int. Cl.
*F04D 29/66* (2006.01)
*F04D 19/00* (2006.01)
(Continued)

(52) U.S. Cl.
CPC ..... *F04D 29/667* (2013.01); *F04D 19/002* (2013.01); *F04D 29/164* (2013.01); *F04D 29/326* (2013.01); *F04D 29/526* (2013.01)

(58) Field of Classification Search
CPC .... F04D 29/326; F04D 29/164; F04D 29/667; F04D 29/526; F04D 19/002
(Continued)

(56) References Cited

U.S. PATENT DOCUMENTS 1,568,034 A * 12/1925 Losel ..... F01D 11/08 415/173.6
3,028,072 A * 4/1962 Atalla ..... F04D 29/326 415/91
(Continued)

FOREIGN PATENT DOCUMENTS

DE 102012207552 A1 11/2012
GB 2358677 A 8/2001
(Continued)

*Primary Examiner* — Umashankar Venkatesan
(74) *Attorney, Agent, or Firm* — Harness, Dickey & Pierce, P.L.C.

(57) ABSTRACT

A blower fan includes a plurality of blades radially extending from a boss provided at a rotary center and spaced apart from each other in the rotational direction, and a ring portion connecting outer peripheral ends of the blades in a ring shape. A radially outer end part at an end on an air-flow upstream side of the ring portion is positioned outward in a radial direction of a rotary shaft in the blower fan, as toward the air-flow upstream side. Thus, the blower can prevent the backflow air from being swirled, thereby reducing noise.

8 Claims, 5 Drawing Sheets

(51) Int. Cl.
*F04D 29/16* (2006.01)
*F04D 29/32* (2006.01)
*F04D 29/52* (2006.01)

(58) Field of Classification Search
USPC ..... 415/173.6
See application file for complete search history.

(56) References Cited

U.S. PATENT DOCUMENTS 4,900,229 A 2/1990 Brackett et al.
5,342,173 A * 8/1994 Vera ..... F04D 19/002 415/914
5,489,186 A 2/1996 Yapp et al.
6,024,537 A * 2/2000 Moreau ..... F04D 29/326 416/169 A
7,114,921 B2 * 10/2006 Iwasaki ..... F04D 29/326 415/173.6
7,481,615 B2 * 1/2009 Park ..... F04D 29/164 123/41.49
2003/0161728 A1 * 8/2003 Cho ..... F04D 29/164 415/222
2005/0074333 A1 * 4/2005 Iwasaki ..... F04D 29/326 416/179
2007/0160468 A1 * 7/2007 Tsubota ..... F01P 5/06 415/173.6
2011/0094460 A1 * 4/2011 Hoskins ..... F04D 29/164 123/41.49
2014/0186172 A1 7/2014 Schafer et al.
2015/0071776 A1 * 3/2015 Scouarnec ..... F04D 29/164 415/208.2
2016/0312788 A1 * 10/2016 Bossi ..... F04D 29/164

FOREIGN PATENT DOCUMENTS

JP H04503392 A 6/1992
JP 2001501284 A 1/2001
JP 2008057480 A 3/2008

* cited by examiner

BLOWER

CROSS REFERENCE TO RELATED APPLICATIONS

This application is a U.S. National Phase Application under 35 U.S.C. 371 of International Application No. PCT/JP2015/000806 filed on Feb. 20, 2015 and published in Japanese as WO 2015/125486 A1 on Aug. 27, 2015. This application is based on and claims the benefit of priority from Japanese Patent Application No. 2014-031517 filed on Feb. 21, 2014. The entire disclosures of all of the above applications are incorporated herein by reference.

FIELD OF THE INVENTION

The present disclosure relates to a blower that blows air to a heat exchanger, such as a radiator.

BACKGROUND ART

Conventionally, a blower is known that includes an axial flow fan for supplying air to a radiator, and a shroud forming an air passage leading from the radiator to the axial flow fan while holding the axial flow fan. In such a blower, the shroud includes a suction port that allows air to be drawn into the axial flow fan and an air outlet that allows air to be blown out of the axial flow fan.

An axial flow ring fan is proposed as the axial flow fan in this kind of blower (for example, see Patent Document 1). The ring fan includes a ring portion that annularly connects the outer peripheral ends of a plurality of blades.

RELATED ART DOCUMENT

Patent Document

[Patent Document 1] Japanese Unexamined Patent Application Publication No. H4-503392

SUMMARY OF INVENTION

Based on the studies by the inventors of the present disclosure, in the blower with the axial flow ring fan, such as that described in Patent Document 1, part of the air blown out of the axial flow fan enters a gap (tip gap) between the ring portion of the axial flow fan and the air outlet of the shroud to cause a backflow. Thus, the backflow coming out of the tip gap forms a swirl in the vicinity of an end surface of the blade on an air-flow upstream side. Once the flow of air drawn into a blower fan hits the swirl, the drawn air flow might be disturbed. The air drawn into the blower fan with its flow disturbed tends to increase noise.

The present disclosure has been made in view of the foregoing matter, and it is an object of the present disclosure to provide a blower device that can reduce noise.

A blower according to an aspect of a present disclosure includes an axial-flow blower fan that is rotatably driven to generate an airflow; and a shroud that is provided with a suction port adapted to allow air to be drawn into the blower fan, and an air outlet adapted to allow air to be blown out of the blower fan. The blower fan includes a plurality of blades radially extending from a boss disposed at a rotation center and spaced apart from each other in a rotational direction, and a ring portion connecting outer peripheral ends of the blades in a circumferential direction. In addition, a radially outer end part at an end on an air-flow upstream side of the ring portion is positioned outward in a radial direction of a rotary shaft in the blower fan, as toward the air-flow upstream side.

With this arrangement, the backflow of air with respect to the blown-air flow (main stream) from the blower fan can be rectified when flowing out of the clearance between the ring portion of the blower fan and the air outlet of the shroud. Thus, the swirl of the backflow air can be prevented from occurring in the vicinity of the end surface on the air-flow upstream side of the blade, thereby suppressing interruption between the drawn air flow into the blower fan and the swirling backflow air therefrom. In this way, the blower can reduce noise due to the interruption between the drawn air into the blower fan and the backflow air.

Note that the sentence "the radially outer end part at the end on the air-flow upstream side of the ring portion is positioned outward in the radial direction of the rotary shaft of the blower fan, toward the air-flow upstream side" as used in the present disclosure means not only that "the entire region of the radially outer end part at the end on the air-flow upstream side of the ring portion is positioned outward in the radial direction of the rotary shaft, toward the air-flow upstream side, but also that "a part of the radially outer end part at the end on the air-flow upstream side of the ring portion is positioned outward in the radial direction of the rotary shaft, toward the air-flow upstream side.

DESCRIPTION OF EMBODIMENTS

Figure 1:
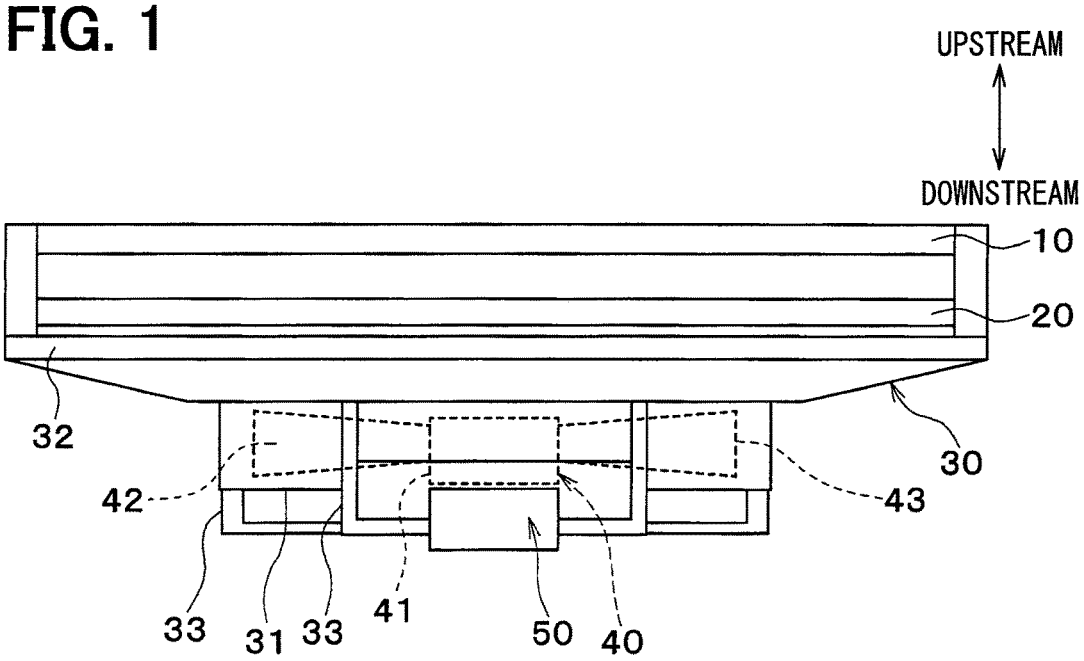
FIG. 1 is a top view showing a blower according to a first embodiment.

In the following, embodiments of the present disclosure will be described with reference to the accompanying drawings. In the respective embodiments below, the same or equivalent parts are indicated by the same reference characters throughout the figures.

First Embodiment

Figure 2:
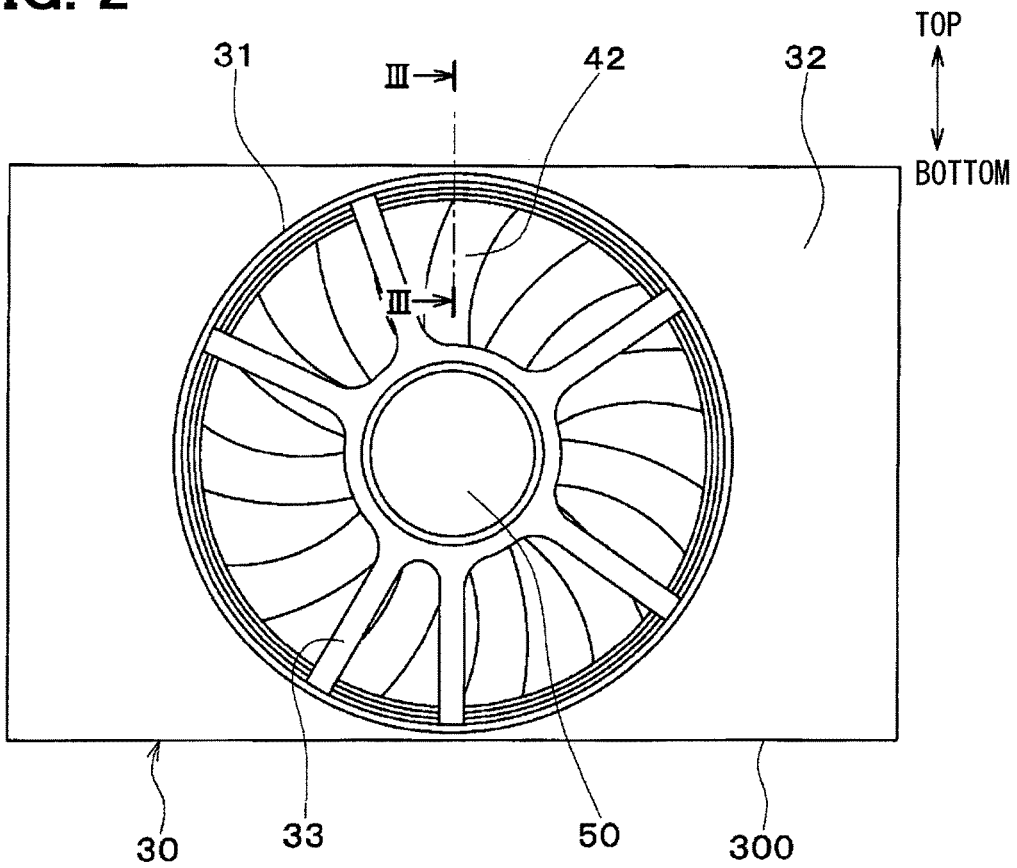
FIG. 2 is a front view of the blower in the first embodiment.
Figure 3:
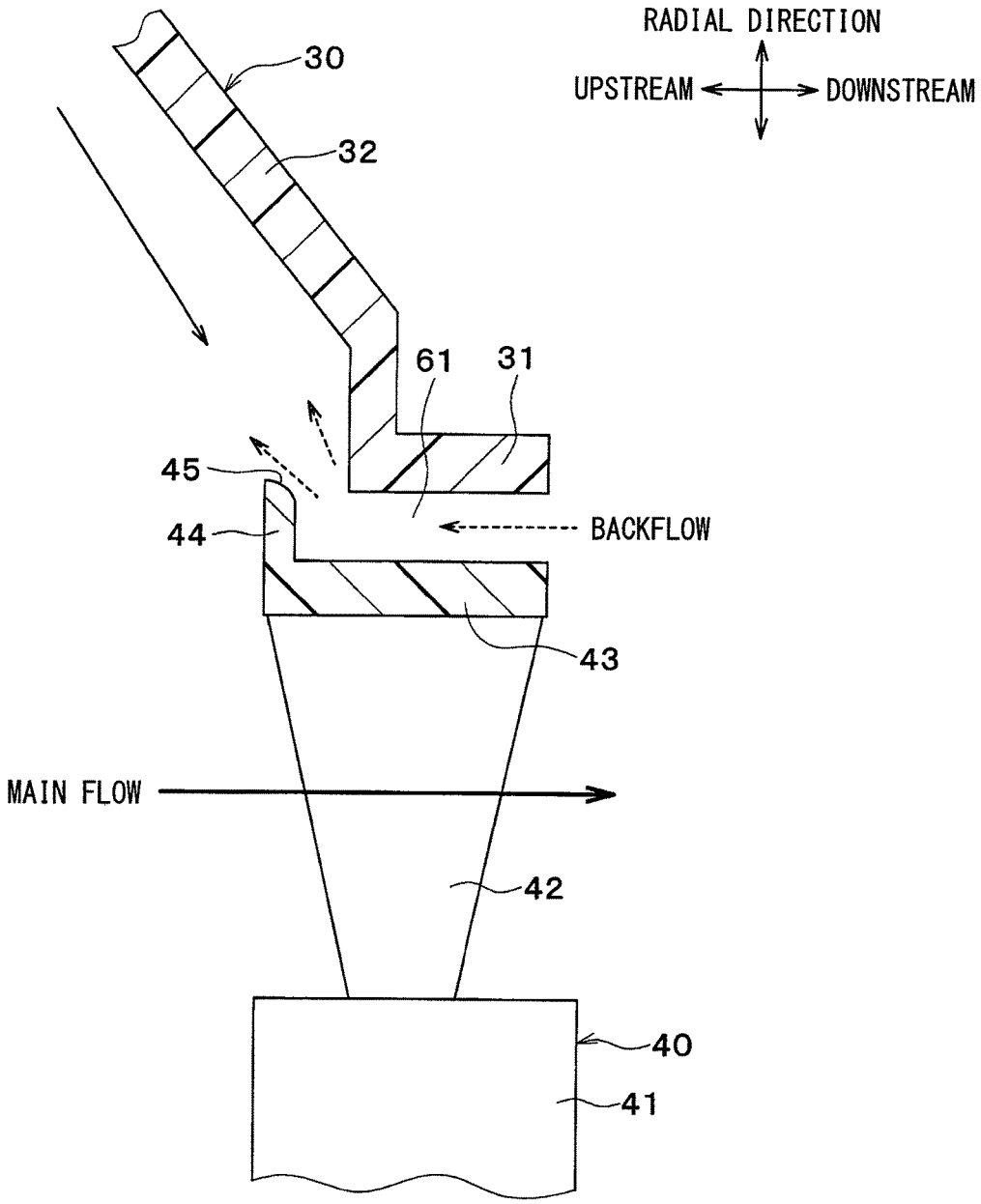
FIG. 3 is a cross-sectional view taken along the line III-III of FIG. 2.

A first embodiment of the present disclosure will be described with reference to the accompanying drawings. As illustrated in FIGS. 1, 2, and 3, a blower described in the embodiment is a blower to be used to cool a refrigerant heat radiation device 10 and a radiator 20 for an automobile. The blower includes a shroud 30, a blower fan 40, and a motor 50.

The refrigerant heat radiation device 10 is a heat exchanger that exchanges heat between the outside air and a refrigerant circulating through a refrigeration cycle (not shown) to thereby cool the refrigerant. The radiator 20 is a heat exchanger that exchanges heat between an engine coolant and the outside air to thereby cool the engine coolant. Each of the refrigerant heat radiation device 10 and the radiator 20 has its outer appearance formed in a rectangular shape (having a substantially oblong figure in the embodiment) in a planar view, that is, in a plane perpendicular to the air flow direction.

The refrigerant heat radiation device 10 is disposed at the vehicle front side, or upstream side of the air flow of the radiator 20. The refrigerant heat radiation device 10 and radiator 20 are coupled and integrated together.

The shroud 30, which is made of resin (e.g., glass fiber-filled polypropylene), is a component that serves to hold the motor 50 while guiding the airflow induced by the blower fan 40 to flow through the refrigerant heat radiation device 10 and the radiator 20. The shroud 30 is disposed at the vehicle rear side, or air-flow downstream side of the radiator 20.

The shroud 30 has a cylindrical portion 31 that is formed in a ring (cylindrical) shape while covering the outer periphery of the blower fan 40, and a plane portion 32 that connects a space on the air-flow downstream side of the radiator 20 to the cylindrical portion 31 by a smooth flow path. In the embodiment, the plane portion 32 forms a suction port of air to be drawn into the blower fan 40, and the cylindrical portion 31 forms an air outlet for blowing the air from the blower fan 40.

The plane portion 32 covers the backside of the radiator 20, that is, the surface on the vehicle rear side of the radiator 20. The plane portion 32 has a tubular shape to communicate with the cylindrical portion 31, and also communicates with the outside.

The cylindrical portion 31 has a circular planar shape. On the other hand, the shroud 30 has a rectangular planar shape. That is, an outer peripheral edge 300 of the shroud 30 has a rectangular planar shape. The area of an opening in the plane portion 32 is larger than that of an opening in the cylindrical portion 31.

The blower fan 40 is an axial-flow blower fan for blowing air and is configured to rotate about a rotary shaft. The blower fan 40 includes a plurality of blades 42 radially extending from a boss 41 provided at the rotation center and spaced apart from each other in the rotational direction, and a ring portion 43 connecting the outer peripheral ends of the blades 42 in a ring shape.

The blower fan 40 is disposed in a hollow part of the cylindrical portion 31 in the shroud 30. A clearance 61 is formed between the outer peripheral surface of the ring portion 43 and the inner peripheral surface of the cylindrical portion 31. Thus, the blower fan 40 is rotatable within the cylindrical portion 31 without contact with the cylindrical portion 31.

The motor 50 is an electric motor that provides the rotary power to the blower fan 40 and has a motor shaft (not shown). The motor 50 is supported by a plurality of motor stators 33 provided at the cylindrical portion 31 of the shroud 30. The motor 50 rotates the blower fan 40 by rotating the motor shaft, thereby generating airflow in a direction of axis of the blower fan 40, that is, in an axial direction of the rotary shaft. The entire structure of the blower has been described above.

Next, the detailed shapes of the cylindrical portion 31 of the shroud 30 and the blower fan 40 will be described.

As shown in FIG. 3, the end on the air-flow upstream side of the ring portion 43 is connected to a flange 44 extending outward in the radial direction of the rotary shaft. In this embodiment, the flange 44 is configured to be directed perpendicular to the air-flow direction. The flange 44 is integrally formed with the ring portion 43. Thus, the flange 44 configures a part of the ring portion 43. The cylindrical portion 31 of the shroud 30 is formed substantially in parallel to a part of the ring portion 43 other than the flange 44. The ring portion 43 includes a parallel portion disposed substantially in parallel to the cylindrical portion 31 extending in the axial direction, and the flange 44 extending outward in the radial direction from the upstream end of the parallel portion.

The end on the air-flow upstream side of the ring portion 43, that is, an outer end part 45 in the radial direction of the flange 44 is positioned outward in the radial direction of the rotary shaft, toward the air-flow upstream side. Specifically, the outer end part 45 in the radial direction of the flange 44 is curved to be positioned outward in the radial direction, toward the air-flow upstream side. In other words, the outer end part 45 of the flange 44 in the ring portion 43 is curved in such a manner as to be spaced apart from the rotary shaft from the air-flow downstream side to upstream side of the rotary shaft.

In this embodiment, the outer end part 45 of the flange 44 positioned at the end on the air-flow upstream side of the ring portion 43 is formed to have an arc cross-section that protrudes outward in the radial direction of the rotary shaft.

As mentioned above, the outer end part 45 of the flange 44 positioned at the end on the air-flow upstream side of the ring portion 43 is curved to be positioned outward in the radial direction, toward the air-flow upstream side. In this way, the backflow of air with respect to the blown-air flow (main stream) from the blower fan 40 can be rectified when flowing out of the clearance 61 between the ring portion 43 of the blower fan 40 and the cylindrical portion 31 of the shroud 30. With this arrangement, the swirl of the backflow can be prevented from occurring in the vicinity of the end surface on the air-flow upstream side of the blade 42, thereby suppressing interruption between the drawn air flow into the blower fan 40 and the swirling backflow air therefrom. Thus, this embodiment can reduce noise that would otherwise be caused by interruption between the drawn air into the blower fan 40 and the backflow air therefrom.

Second Embodiment

Next, a second embodiment of the present disclosure will be described based on FIG. 4. In the second embodiment, the shape of the outer end part 45 of the flange 44 positioned at the end on the air-flow upstream side of the ring portion 43 is changed, compared to that in the above-mentioned first embodiment.

Figure 4:
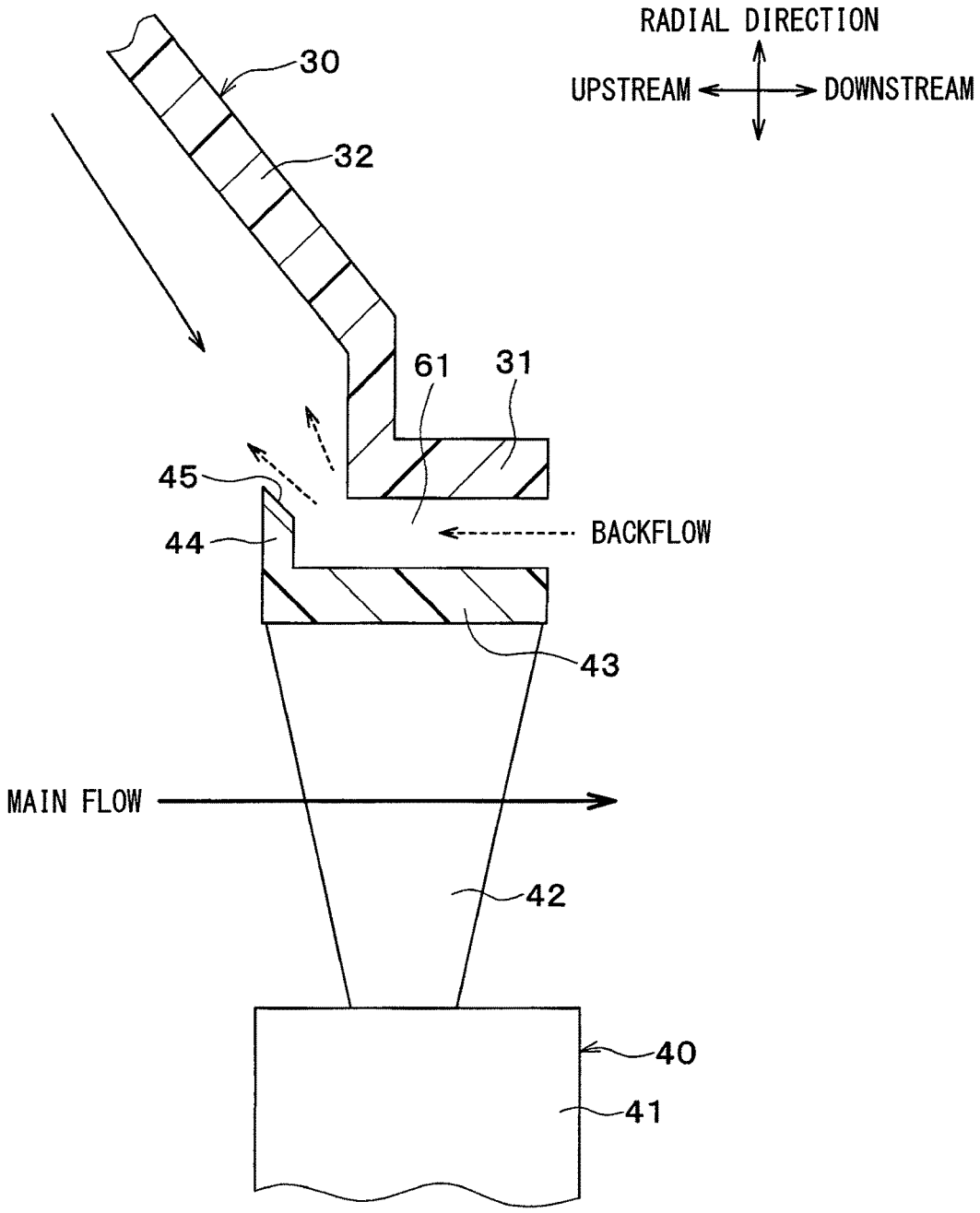
FIG. 4 is a cross-sectional view showing a part of a blower according to a second embodiment.

As shown in FIG. 4, in the second embodiment, the outer end part 45 of the flange 44 positioned at the end on the air-flow upstream side of the ring portion 43 is linearly inclined outward in the radial direction of the rotary shaft, toward the air-flow upstream side. That is, the outer end part 45 of the flange 44 is inclined to linearly expand outward in the radial direction, from the air-flow downstream side to upstream side.

This embodiment can rectify the backflow of air coming out of the clearance 61 between the ring portion 43 of the blower fan 40 and the cylindrical portion 31 of the shroud 30, and thus can obtain the same effects as those of the first embodiment.

Third Embodiment

Next, a third embodiment of the present disclosure will be described based on FIG. 5. In the third embodiment, the shape of the outer end part 45 of the flange 44 positioned at the end on the air-flow upstream side of the ring portion 43 is changed, compared to that in the above-mentioned first embodiment.

Figure 5:
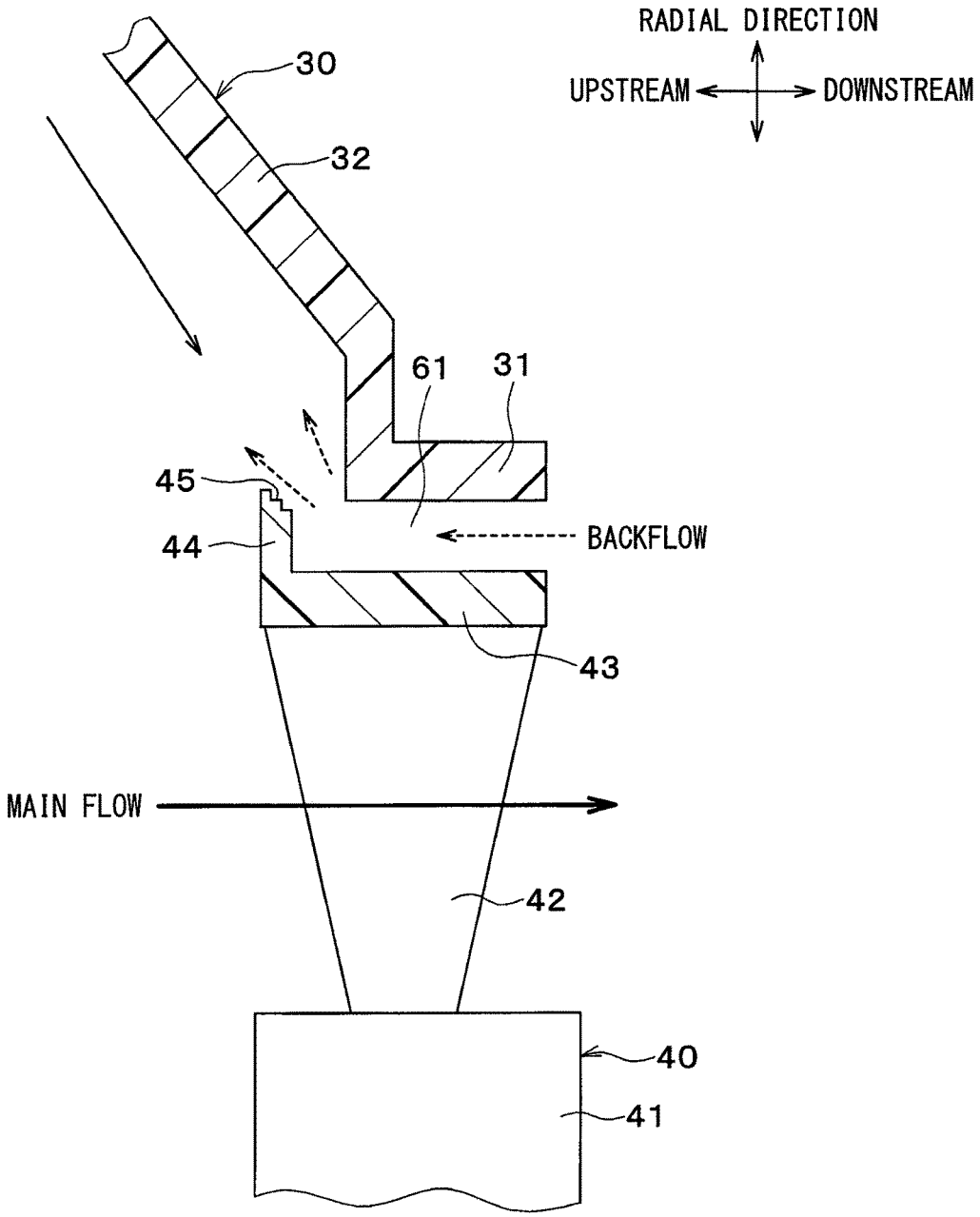
FIG. 5 is a cross-sectional view showing a part of a blower according to a third embodiment.

As shown in FIG. 5, in the third embodiment, the outer end part 45 in the radial direction of the flange 44 has its cross-section formed with a stepped shape to expand outward in the radial direction from the air-flow downstream side to upstream side in a stepwise manner. This embodiment can rectify the backflow of air coming out of the clearance 61 between the ring portion 43 of the blower fan 40 and the cylindrical portion 31 of the shroud 30, and thus can obtain the same effects as those of the first embodiment.

Other Embodiments

The present disclosure is not limited to the above-mentioned embodiments, and various modifications and changes can be made to these embodiments without departing from the scope and spirit of the present disclosure.

(1) In each of the above-mentioned embodiments, the entire region of the outer end part 45 of the flange 44 located at the end on the air-flow upstream side of the ring portion 43 is positioned outward in the radial direction of the rotary shaft, toward the air-flow upstream side, as described by way of example.

Figure 6:
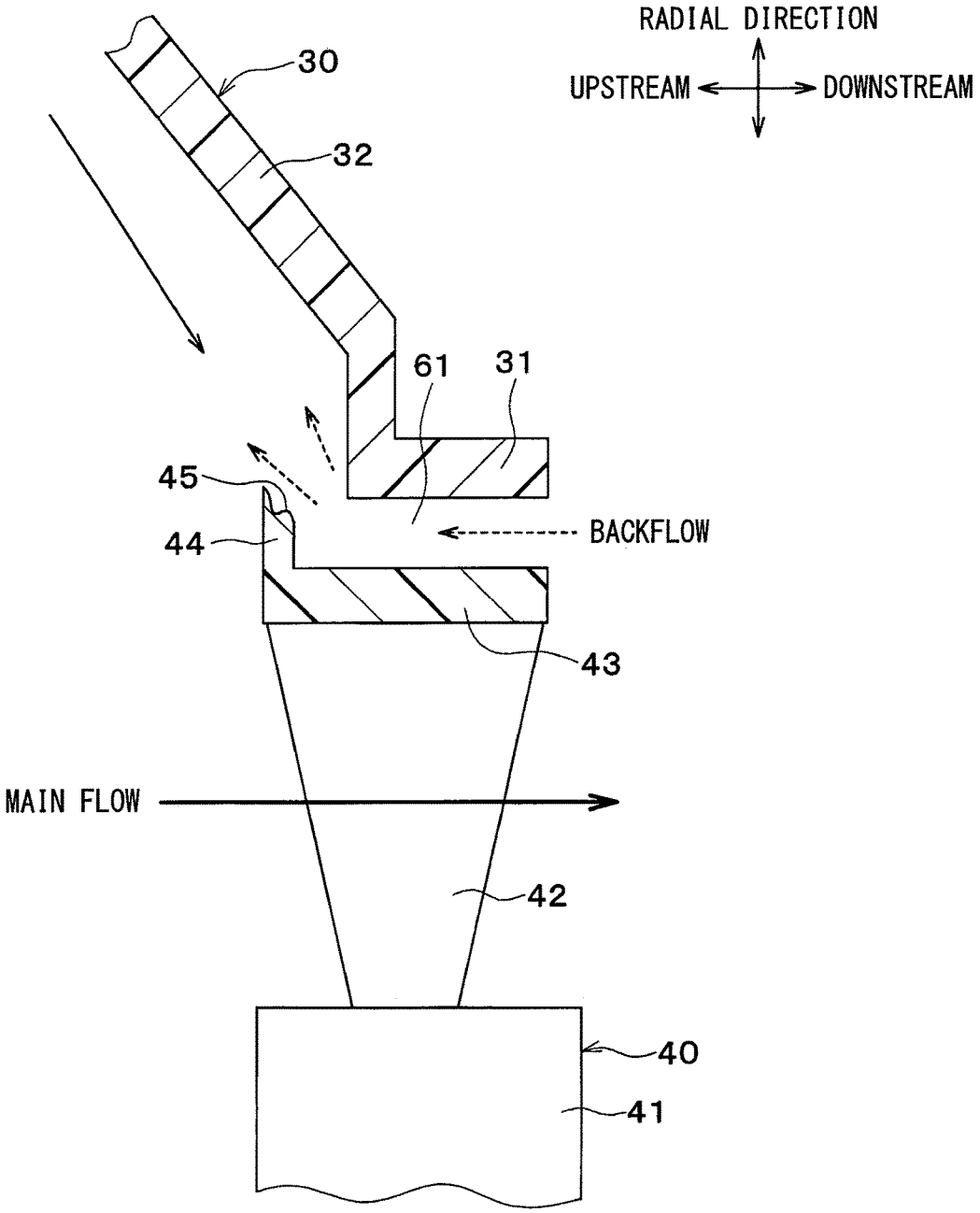
FIG. 6 is a cross-sectional view showing a part of a blower according to another embodiment.

However, these embodiments are not limited thereto. For example, as shown in FIG. 6, a part of the outer end part 45 of the flange 44 may be positioned outward in the radial direction, toward the air-flow upstream side.

(2) In each of the above-mentioned embodiments, the flange 44 of the ring portion 43 is configured to be directed perpendicular to the air-flow direction by way of example, but these embodiments are not limited thereto. Alternatively, the flange 44 of the ring portion 43 may be inclined with respect to the air-flow direction.

(3) The above-mentioned respective embodiments may be combined together within the feasible range as appropriate.

(4) In each of the above-mentioned embodiments, the blower of the present disclosure is configured as a blower that is used to cool the refrigerant heat radiation device 10 and radiator 20 in automobiles as mentioned above, which is just an example. That is, the blower is not limited to the structure described above, and can have other structures that enable achievement of the present disclosure. For example, the blower may have a structure including at least the shroud 30 and the blower fan 40.

What is claimed is:

1. A blower comprising:

an axial-flow blower fan that is rotatably driven to generate an airflow; and a shroud provided with a suction port adapted to allow air to be drawn into the blower fan and an air outlet adapted to allow air to be blown out of the blower fan, the blower fan including:

a plurality of blades radially extending from a boss disposed at a rotation center and spaced apart from each other in a rotational direction; and a ring portion connecting outer peripheral ends of the blades in a circumferential direction, wherein an end of the ring portion on the air-flow upstream side is connected to a flange extending outward in a radial direction of a rotary shaft of the blower fan, the flange extending along a direction perpendicular to the air-flow, and an entire region of a radially outer end part of the flange from a downstream end to an upstream end is positioned outward in the radial direction of the rotary shaft, as toward the air-flow upstream side.

2. The blower according to claim 1, wherein the radially outer end part of the flange smoothly protrudes and is curved outward in the radial direction of the rotary shaft.

3. The blower according to claim 1, wherein the radially outer end part of the flange is linearly inclined outward in the radial direction of the rotary shaft, as toward the air-flow upstream side.

4. The blower according to claim 1, wherein the blower fan is disposed to form a clearance between the air outlet of the shroud and the ring portion of the blower fan, and the radially outer end part of the flange is provided such that a backflow of air with respect to an airflow blown from the blower fan is capable of being rectified when flowing out of the clearance.

5. The blower according to claim 1, wherein the ring portion includes a parallel portion that extends in parallel to the air outlet in an axial direction, and the flange extends from an upstream end of the parallel portion.

6. A blower comprising:

an axial-flow blower fan that is rotatably driven to generate an airflow; and a shroud provided with a suction port adapted to allow air to be drawn into the blower fan and an air outlet adapted to allow air to be blown out of the blower fan, the blower fan including:

a plurality of blades radially extending from a boss disposed at a rotation center and spaced apart from each other in a rotational direction; and a ring portion connecting outer peripheral ends of the blades in a circumferential direction, wherein an end of the ring portion on the air-flow upstream side is connected to a flange extending outward in a radial direction of a rotary shaft of the blower fan, the flange extending along a direction perpendicular to the air-flow, and a radially outer end part of the flange is linearly inclined outward and positioned outward in the radial direction of the rotary shaft, as toward the air-flow upstream side.

7. The blower according to claim 6, wherein the blower fan is disposed to form a clearance between the air outlet of the shroud and the ring portion of the blower fan, and the radially outer end part of the flange is provided such that a backflow of air with respect to an airflow blown from the blower fan is capable of being rectified when flowing out of the clearance.

8. The blower according to claim 6, wherein the ring portion includes a parallel portion that extends in parallel to the air outlet in an axial direction, and the flange extends from an upstream end of the parallel portion.

* * * * *